US011465111B2

(12) United States Patent
Lin et al.

(10) Patent No.: US 11,465,111 B2
(45) Date of Patent: Oct. 11, 2022

(54) MINI MIXER SYSTEM

(71) Applicant: NATIONAL CHUNG SHAN INSTITUTE OF SCIENCE AND TECHNOLOGY, Taoyuan (TW)

(72) Inventors: Chih-Yang Lin, Kaohsiung (TW); Ruei-Horng Huang, Kaohsiung (TW); Jin-Shan Lu, Pingtung (TW)

(73) Assignee: NATIONAL CHUNG SHAN INSTITUTE OF SCIENCE AND TECHNOLOGY, Taoyuan (TW)

( * ) Notice: Subject to any disclaimer, the term of this patent is extended or adjusted under 35 U.S.C. 154(b) by 211 days.

(21) Appl. No.: 16/941,545

(22) Filed: Jul. 29, 2020

(65) Prior Publication Data

US 2022/0032248 A1 Feb. 3, 2022

(51) Int. Cl.
*B22C 5/00* (2006.01)
*B01F 35/32* (2022.01)
(Continued)

(52) U.S. Cl.
CPC ..... *B01F 35/3204* (2022.01); *B01F 27/112* (2022.01); *B01F 27/84* (2022.01); *B01F 27/906* (2022.01); *B01F 35/212* (2022.01); *B01F 35/2115* (2022.01); *B01F 35/221422* (2022.01); *B01F 35/6052* (2022.01); *B01F 35/92* (2022.01); *B01F 35/33* (2022.01); *B01F 2035/352* (2022.01); *B01F 2035/99* (2022.01);
(Continued)

(58) Field of Classification Search
CPC ..... B01F 27/84
See application file for complete search history.

(56) References Cited

U.S. PATENT DOCUMENTS

2009/0135666 A1* 5/2009 Watano ..... B02C 18/00 366/98
2011/0020177 A1* 1/2011 Gijtenbeek ..... B01F 23/53 422/292
2019/0217258 A1* 7/2019 Bishop ..... B01F 23/50

FOREIGN PATENT DOCUMENTS

CN 107670611 A * 2/2018 ..... B01F 15/068
CN 108786559 A * 11/2018
(Continued)

OTHER PUBLICATIONS

PE2E Search machine translation for "CN-107670611-A" (Year: 2018).*
(Continued)

*Primary Examiner* — Anshu Bhatia
*Assistant Examiner* — Gregory Y Huan

(57) ABSTRACT

A mini mixer system includes a mixer, for executing a continuous mixing operation for an extended period of time, the mixing operation includes a mixing production process with corrosiveness, high viscosity and high mixing risks. The mixer includes a motor, a coupling and torsion meter, a reduction gear, a plurality of couplings, a frame group, a gear box group, at least one mixing element, a mixing can and a lifting mechanism group. The motor, the coupling and torsion meter and the reduction gear are connected to one another by the couplings. The reduction gear is connected to the gear box group by the coupling. The motor, the reduction gear, the gear box group and the lifting mechanism group are all fixed on the frame group. The mixer is assembled in a gear mechanism of the gear box group. The mixing can is disposed on the lifting mechanism group.

13 Claims, 10 Drawing Sheets

(51) Int. Cl.

| | |
|---|---|
| ***B01F 27/84*** | (2022.01) |
| ***B01F 27/112*** | (2022.01) |
| ***B01F 27/906*** | (2022.01) |
| ***B01F 35/92*** | (2022.01) |
| ***B01F 35/212*** | (2022.01) |
| ***B01F 35/21*** | (2022.01) |
| ***B01F 35/60*** | (2022.01) |
| ***B01F 35/221*** | (2022.01) |
| *B01F 35/33* | (2022.01) |
| *B01F 35/90* | (2022.01) |
| *B01F 35/30* | (2022.01) |
| *B01F 101/00* | (2022.01) |

(52) U.S. Cl.
CPC . *B01F 2101/2202* (2022.01); *B01F 2101/505* (2022.01); *B01F 2215/0431* (2013.01)

(56) References Cited

FOREIGN PATENT DOCUMENTS

| | | | | |
|---|---|---|---|---|
| CN | 109224893 | A | * | 1/2019 |
| CN | 110665381 | A | * | 1/2020 |

OTHER PUBLICATIONS

Google machine translation for "CN-110665381-A" (Year: 2020).*
Google machine translation for "CN-109224893-A" (Year: 2019).*
Google machine translation for "CN-108786559-A" (Year: 2018).*

* cited by examiner

MINI MIXER SYSTEM

BACKGROUND OF THE INVENTION

1. Field of the Invention

The present invention relates to a mini mixer system featuring advantages of quick release, transportation, installation and user friendly in operation, and more particularly to a mini mixer system that provides good reliability, good mixing efficiency, good safety, and good corrosion resistance and ease of use, and has environmental control functions such as vacuum degree and temperature of the environment as well as a mixing function with a multi-stage rotating speed/time setting mechanism.

2. Description of the Related Art

In the current production of energetic fuels, formulation development, and so on in Taiwan, for mixing tasks in the formulation development stage, development and formulation testing of low-dose systems such as small rockets, casting medicine process optimization, and research on manufacturability, a mini mixer, having a capacity of about 500 g, of the model number "2PX Vertical Mixer" by APV Chemical Machinery Inc. is used.

The foregoing mini mixer 2PX has the following issues:

(1) While operating a lifting mechanism for a sealing process of a mixing can and a gear box, it is frequent that the mixing can is not reliably sealed with the gear box, undesirably affecting the mixing process and vacuum operation.

(2) For an operating stirring viscosity requirement of 20 kP or less, it is discovered that mixing blades of the 2PX Vertical Mixer may become deformed, indicating insufficient structural design strength of the blades that result in such deformation of the blades.

(3) During the mixing process, the mixing can needs to be vacuumed. However, the current view window is susceptible to leakage, in a way that a vacuum degree of 10 torr or less cannot be achieved.

(4) With respect to control functions, the rotating speed is controlled by a DC motor speed governor and turning on and off is controlled by a button switch, and no other safety monitoring function is provided. Thus, once the equipment is activated and run by operating staff, the mixing process time is recorded only by the operating staff and the operation is suspended by the stage of the mixing process time in order to observe conditions of mixing. That is, operating conditions of the equipment cannot be effectively monitored.

(5) With respect to overall system planning, wires of the equipment includes supply lines and control lines and communication lines, with wires respectively in large quantities. Thus, removal and installation are quite inconvenient, and may have risks of erroneous installation.

Therefore, in view of the issues above, the inventor has dedicated on the basis of years of experience in design, development and actual manufacturing of the industry, to research and development for an improvement for the drawbacks of the current structure, and provides a mini mixer system in aim of achieving the object of better practicability.

BRIEF SUMMARY OF THE INVENTION

In view of the foregoing drawbacks of the prior art, it is an object of the present invention to provide a modularized mini mixer system applicable to a mixing production process with corrosiveness, high viscosity (10 Pa·s or more) and high mixing risks. The mixer system of the present invention features good reliability, good mixing efficiency, good safety, and good corrosion resistance and ease of use, and has vacuum degree and temperature monitoring functions. By incorporating a vacuum pump and a hot water circulation system into the mixer system, a mixture can be blended under the conditions of constant vacuum and constant high temperature.

To achieve the above object, the present invention provides a mini mixer system, the components of the mini mixer system including: a mixer, for performing a continuously mixing operation for an extended period of time, the mixer including a motor, a coupling and torsion meter, a reduction gear, a plurality of couplings, a frame group, a gear box group, at least one mixing element, a mixing can and a lifting mechanism group, wherein the motor, the coupling and torsion meter and the reduction gear are connected to one another via the couplings, the coupling of the reduction gear is connected to the gear box group. The motor, the reduction gear, the gear box group and the lifting mechanism group are assembled and fixed on the frame group, the mixing element is assembled in a gear mechanism of the gear box group, the mixing can is placed on the lifting mechanism group and having a capacity of more than zero and less than one liter; an input/output (IO) unit, disposed in a control room, used as a remote control interface, being electrically connected to the mixer, the IO unit having control functions including mixer activation and deactivation function with mixer three-stage or multi-stage operating time and rotating speed setting function, total operating time display function, execution record window display function, abnormal current detection and detection delay time setting function, real-time detected motor current display function, real-time detected motor speed display function, real-time detected motor torsion display function, mixing can temperature display function, mixer overload reminder (including sound) function, an emergency stop switch, and abnormal detection description, wherein the mixer three-stage or multi-stage operating time and rotating speed setting function is for setting a target operating time of the motor of the mixer at a predetermined rotating speed and for a continuous stepped operation; and a powering and control unit, disposed near the mixer, electrically connected to the mixer and the IO unit, being a main power supply box of the mixer and an intermediary station of control signals and detection signals between the IO unit and the mixer.

Preferably, the IO unit, the powering and control unit and the mixer are connected by quick connectors in between, so as to quickly separate or assemble the IO unit, the powering and control unit and the mixer, providing functions of quick release, transportation and installation, and improving removal and installation inconveniences caused by independent system wires of the 2PX Vertical Mixer.

Preferably, the gear box group includes a gear box body and a view window, and an O ring is added between the gear box body and the view window. The sealing vacuum degree of the view window is 10 torr or less and has a burst pressure relief function. In the present invention, a nested view window is designed to adapt to vacuum requirements so that the sealing vacuum degree of the view window may be 10 torr or less, thus improving the issue of vacuum leakage of the 2PX Vertical Mixer. Further, to attend to the possibility of explosion during a mixing and blending process for an energetic material that is considered a sensitive mixture, a pressure relief hole needs to be provided, such that the nested view window also provides a burst pressure relief function.

Preferably, the mixing element includes two mixing blades. The two blades are a fast blade and a slow blade that perform mutual mixing by rotation and revolution. The mixing blade is structured as having a total length of 200 mm to 240 mm, a diameter of 16 mm to 22 mm, a blade bearing support height of 70 mm to 95 mm, and a distance from the bottom of the blade to the bearing height of 150 mm to 170 mm. According to such ratio design concept has two values, one of the ratio, a blade of the height (length) from the bottom to the top bearing divided by the height from the waist bearing to the top bearing, is 2.4 to 3.0, and the other ratio, the height (length) from the shoulder to the top bearing divided by the height (length) from the waist bearing to the top bearing, is 1.5 to 2.0.

Preferably, a hot water circulation system is further included. The hot water circulation system includes an electric water heater, a water pump and a temperature sensor, and is connected to the mixing can via a temperature resistant water pipe and a quick connector. The wall of the mixing can has a sandwich design which is in conjunction with the hot water circulation system to heat the mixing can. Meanwhile, the mixing can is installed with the temperature sensor, and monitoring is performed by the IO unit. The sandwich design is for creating a high temperature mixing environment, so as to increase ease of mixing of the mixture and reducing the mixing viscosity of the mixture.

Preferably, the IO unit is provided with a key-type power-off switch. When operating staff is to head to the location of the mixer from the control room, the power of the IO unit is first turned off by the key-type power-off switch in order to prevent an unintentional operation of the IO unit and prevent false touch.

Preferably, a vacuum pump is further included. The vacuum pump is connected to the mixer by a vacuum pipe, and simultaneously vacuums the mixing can and the gear box group to create a vacuum environment for the mixing, reduce the amount of gas in the mixture, and enhance mixing efficiency.

Preferably, the frame group includes an adjustment flange that provides a levelled adjustment margin of 1 mm to 2 mm, so as to prevent locating issues of the mixing can and the gear box group caused by accumulated assembly errors or processing errors.

The expected objects, adopted measures, means and effects of the present invention are as described above and further to be described in the detail with the accompany drawings below. Other objects and advantages of the present invention are to be given in the following description and drawings.

DETAILED DESCRIPTION OF THE INVENTION

Implementation details of the present invention are described in the specific embodiments for a technician to understand other advantages and effects of the present invention on the basis of the disclosure of the application.

Figure 1:
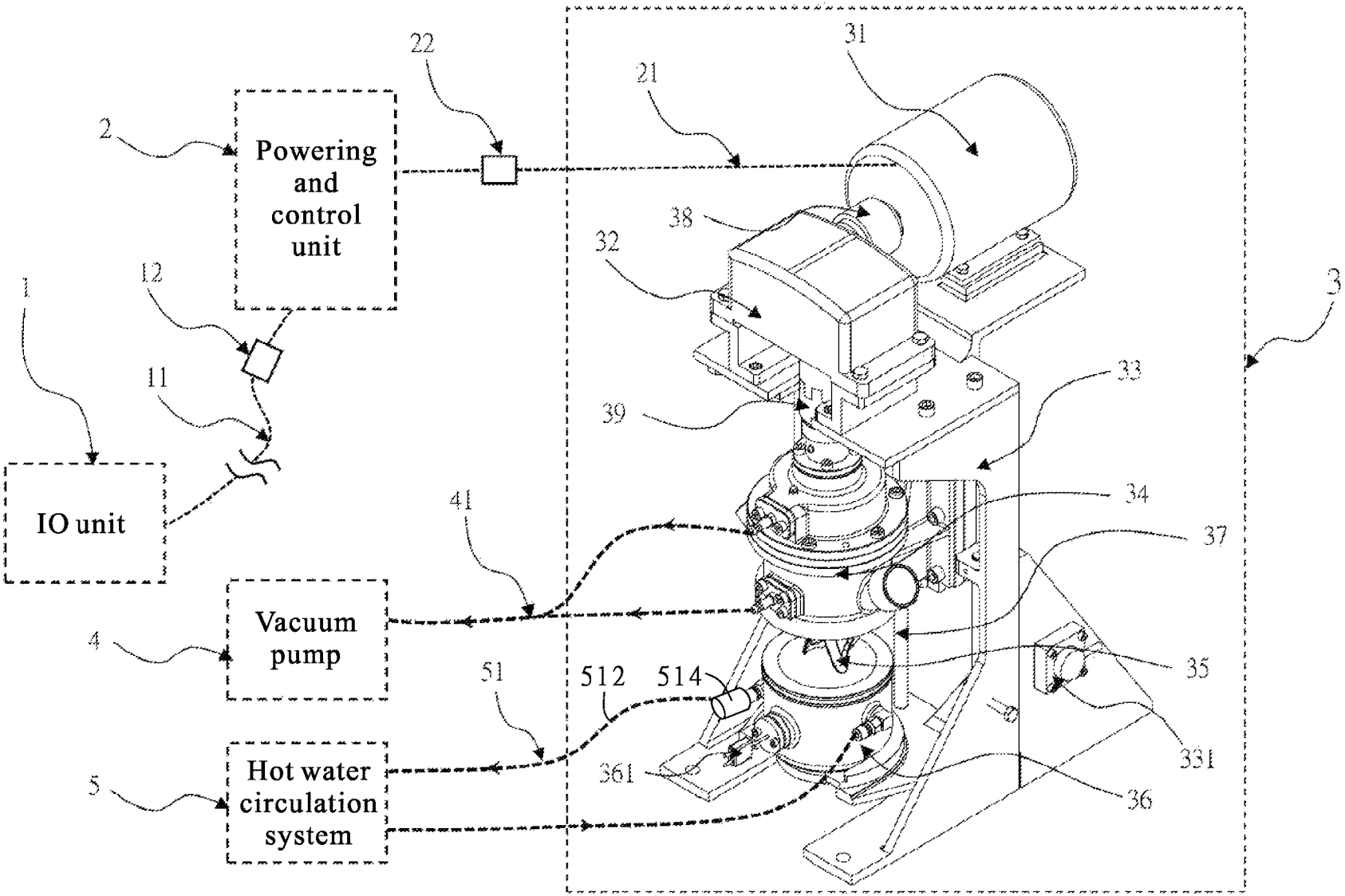
FIG. 1 is a system configuration schematic diagram of a mini mixer system according to a preferred embodiment of the present invention.

Referring to FIG. 1, FIG. 1 shows a system configuration schematic diagram of a mini mixer system according to a preferred embodiment of the present invention. As shown, the embodiment of the present invention includes an input/output (IO) unit 1, a powering and control unit 2, a mixer 3, a vacuum pump 4, and a hot water circulation system 5.

The vacuum pump 4 applied in the present invention is connected to a gear box group 34 of the mixer 3 by a vacuum pipe 41, and is sealed by an O ring once a mixing can 36 and the gear box group 34 are sealed. The inside of the mixing can 36 becomes a seal cavity, in which a negative pressure may be formed by the vacuum pump 4, so as to reduce the content of bubbles in the mixture and enhance mixing efficiency. The vacuum degree is 10 torr or less. The mix capacity of the mixing can is suitable for a blended requirement of about 500 g, and thus the capacity of the mixing can is more than 0 and less than 1 liter, and is preferably, 0.5 to 0.7 liter.

The hot water circulation system 5 applied in the present invention is for heating a sandwich design 362 on the outer side of the mixing can 36, such that the temperature of the mixing can 36 reaches to a utilization condition temperature and to a temperature range of 80° C. or less, while the temperature may be maintained at a target temperature.

The hot water circulation system 5 applied in the present invention includes an electric water heater (not shown), a water pump (not shown) and a temperature sensor 361, and is connected to the mixing can 36 by a circulation water pipeline 51 (a temperature resistant pipe 512 and a quick connector 514). The wall of the mixing can 36 includes the sandwich design 362, which is in conjunction with the hot water circulation system 5 to heat the mixing can 36. Meanwhile, the mixing can 36 is installed with a temperature sensor, and monitoring is performed by the IO unit 1. The sandwich design is for creating a high temperature mixing environment, so as to enhance ease of mixing of the mixture and reduce the mixing viscosity of the mixture.

The IO unit 1 of the present invention is disposed in a control room (a control room at a distal location from the mixer 3) to serve as a remote control interface, and is electrically connected to the mixer 3. The IO unit 1 of the present invention is connected to the powering and control unit 2 by a control signal line 11 and a quick release connector 12 at a distance of more than 25 m. Thus, operating staff may be away from the site of operation to avoid danger when operating. The powering and control unit 2 is disposed near the mixer 3, and is electrically connected to the mixer 3 and the IO unit 1, to serve as a main power supply box for the mixer 3 and as an intermediary station of control and detection signals between an IO unit control panel 1 and the mixer 3. The powering and control unit 2 is connected to the motor 31 by a line 21 and a military standard fast release connector 22 at a distance of more than 8 m.

As in the embodiment shown in FIG. 1, the connection between the IO unit 1 and the powering and control unit 2 is implemented by the quick connector 12, and the connection between the powering and control unit 2 and the mixer 3 is implemented by the quick connector 22, hence providing features of quick release, transportation and installation.

Operating staff remotely operates the IO unit 1 to transmit a digital signal to the powering and control unit 2, and an execution signal is provided from the powering and control unit 2 to the motor 31, hence prompting the motor 31 to perform operations such as activation, deactivation and speed adjustment. Further, the IO unit 1 is provided with a key-type power-off switch (not shown). When operating staff is to head toward the site of equipment, the power of the IO unit 1 is first disconnected by the key-type power-off switch in order to prevent unintentional operation of the IO unit 1 and personnel risk and to prevent false touch.

Figure 2:
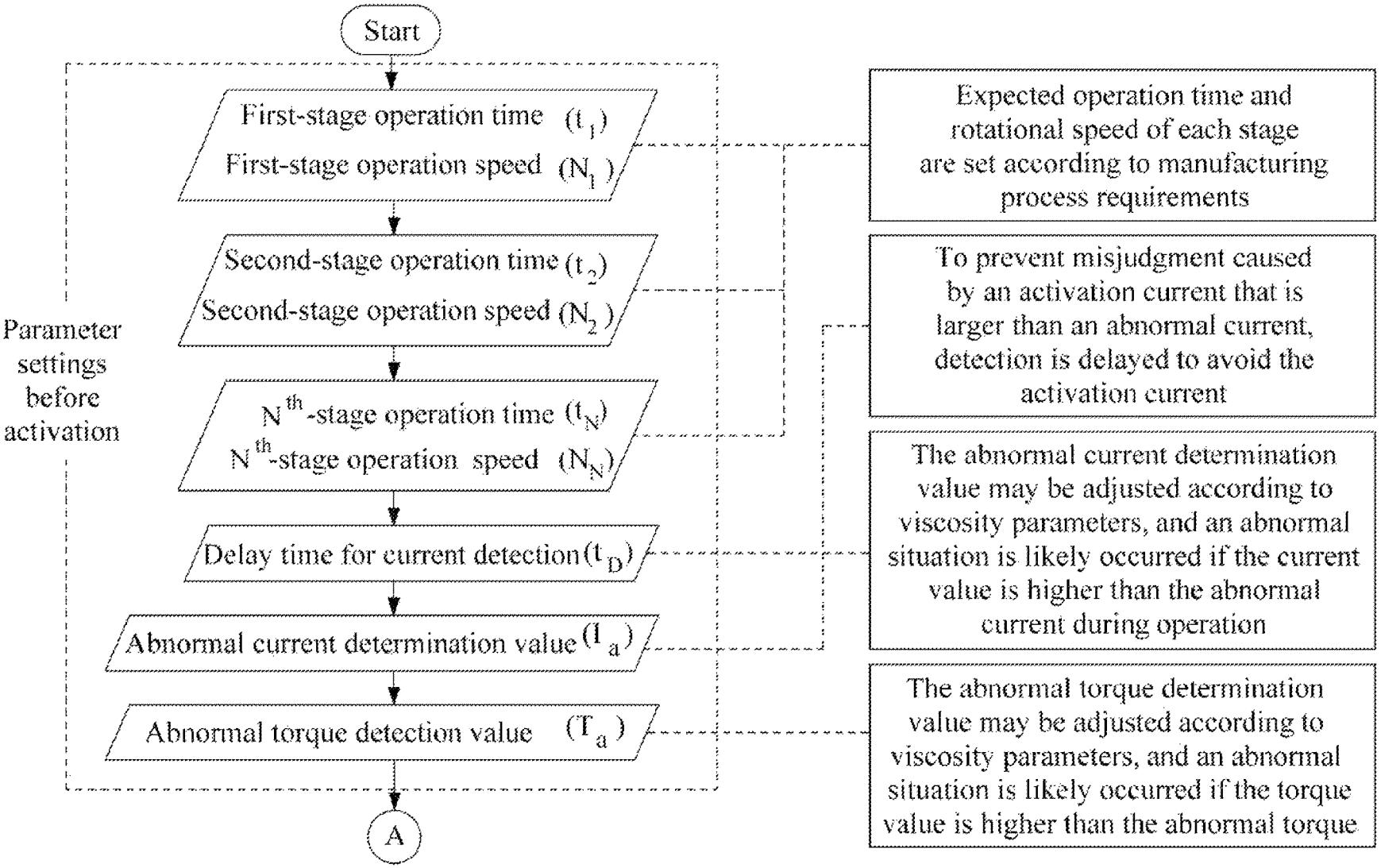
FIG. 2 is a schematic diagram of a parameter setting procedure before activation of a mini mixer system according to a preferred embodiment of the present invention.
Figure 3:
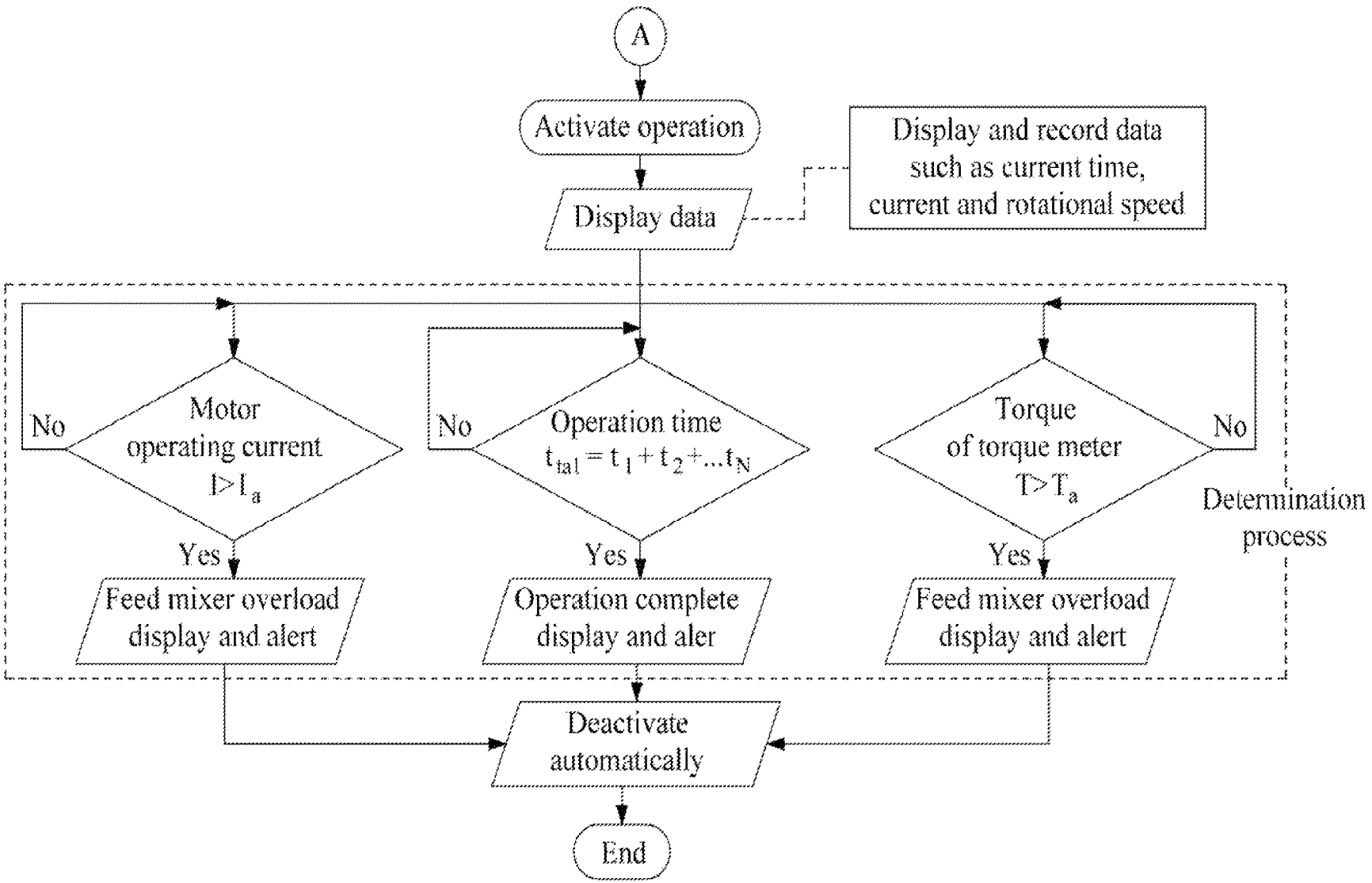
FIG. 3 is a schematic diagram of a control and procedure determination of a mini mixer system according to a preferred embodiment of the present invention.

The operation procedure and the determination procedure are as shown in FIG. 2. Parameters are set on the IO unit 1 before mixing is activated, including four parameters of (1) operating time and speed of each stage, (2) delay time of current detection $t_D$, (3) abnormal current determination value $I_a$, and (4) abnormal torsion detection value $T_a$. The operating staff may then press the activation button on the IO unit 1. As shown in FIG. 3, after the activation, data including the current time, current, rotating speed and torsion is displayed on the IO unit 1, wherein a program automatically determines whether an abnormality has occurred or whether the mixing operation time is complete by the determination procedure, and further performs turning off and displays current conditions on the IO unit 1.

When an alien object or an abnormal condition is present in the mixing can 36, the motor current rises and the torsion value also increases, and thus, the setting is capable of effectively determining whether the mixing conditions are abnormal. Further, the powering and control unit 2 also includes a control panel, and operating staff may perform operations using the control panel for inspection, repair, maintenance or unexpected situations.

Figure 4:
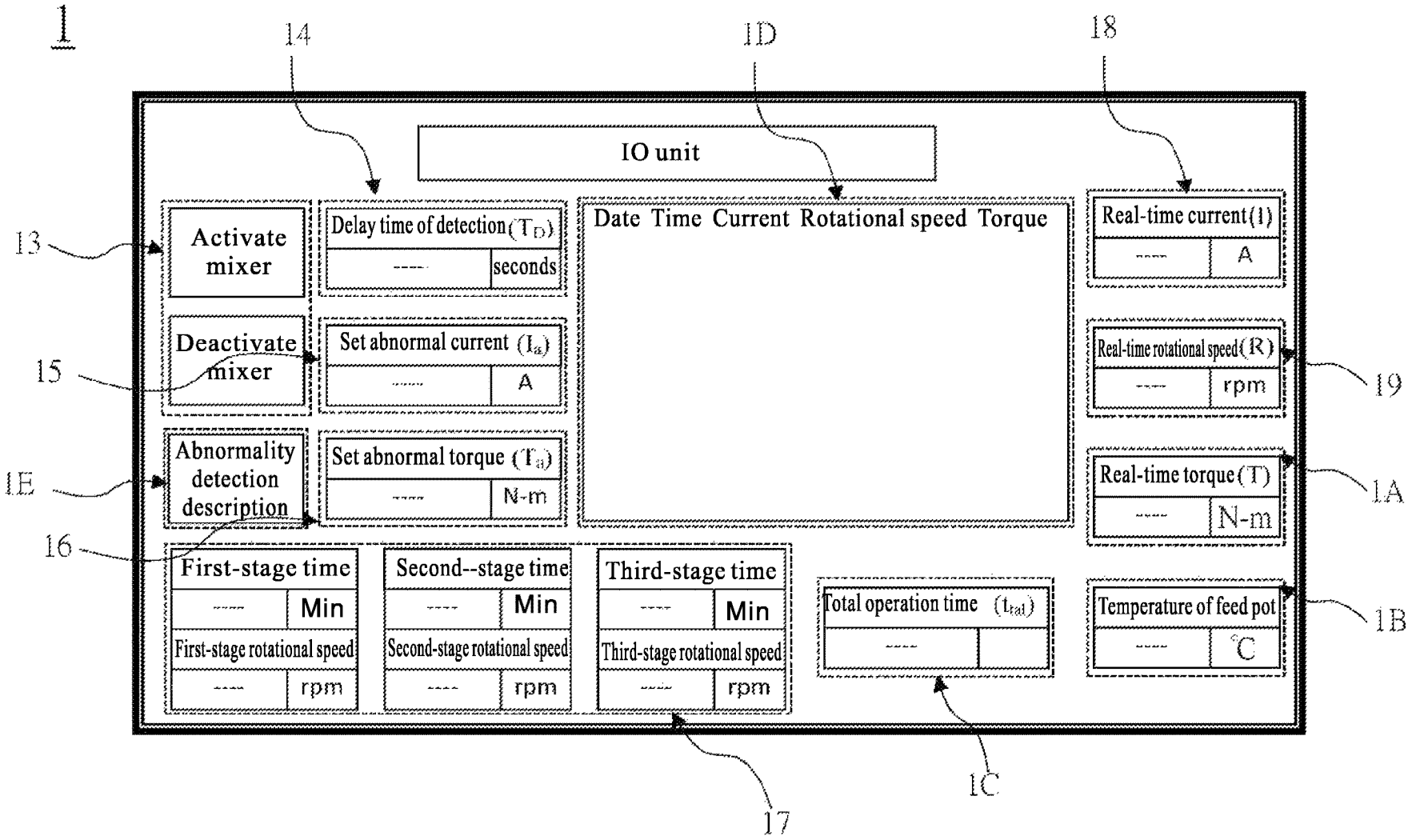
FIG. 4 is a schematic diagram of a control interface of an input/output (IO) unit of a mini mixer system according to a preferred embodiment of the present invention.

The IO unit 1 primarily serves functions of control, monitoring and abnormality determination. As shown in FIG. 4, functions of the IO unit 1 include:

(1) Mixer activation and deactivation 13: operating staff controls the mixer 3 to activate or the mixer 3 to deactivate by a touch button on the IO unit 1;

(2) Set delay time of detection 14: the detection time is delayed to prevent detection of activation current that may cause misjudgment;

(3) Set abnormal current 15: an upper limit of an abnormal motor current detected is set, and the current mixer 3 is automatically deactivated when the motor current exceeds the upper limit during operation and the current overload duration exceeds the delay time of detection;

(4) Set abnormal torsion 16: detection for an upper limit of an abnormal motor torsion is set, and the mixer 3 is automatically deactivated when the motor torsion exceeds the upper limit during operation;

(5) Set mixer three-stage or multi-stage operation time and rotating speed 17: a first-stage operation time $t_1$/first-stage operation speed $N_1$, a second-stage operation time $t_2$/second-stage operation speed $N_2$, a third-stage operation time $t_3$/third-stage operation speed $N_3$, and an $N^{th}$-stage operation time $t_N$/$N^{th}$-stage operation speed $N_N$ are set. The continuous stepped operation of the first stage, the second stage and the third stage is performed, and once all the time of the three steps is complete, the mixer 3 is automatically deactivated and awaits for further handling of operating staff;

(6) Real-time detected current display 18: the motor current value currently detected is displayed;

(7) Real-time detected rotating speed display 19: the motor rotating speed currently detected is displayed;

(8) Real-time detected torsion display 1A: the motor torsion value currently detected is displayed, and the viscosity state and the mixing uniformity of the mixture may be preliminary evaluated through the change of the torsion;

(9) Real-time detected mixing can temperature display 1B: the mixing can temperature currently detected is displayed;

(10) Total operation time display 1C: the accumulated operation time from activation to a current time point of the mixer 3 is displayed;

(11) Execution record window display 1D: after powering on, data such as the current time, date, current, rotating speed and torsion is recorded and displayed at an interval of every 10 seconds (adjustable), and the recorded data may be outputted in an excel file format and stored and backed-up;

(12) Detected abnormality description 1E: once an abnormality has occurred and eliminated, operating staff may touch the "detected abnormality description" button on the IO unit 1, another interface is entered after the touch, and the time and reasons of the abnormality are displayed for reference of subsequent issue clarification;

(13) Emergency stop switch (not shown): the IO unit 1 is provided with a mechanical emergency stop switch, and operating staff may immediately press the emergency stop switch upon discovering any equipment abnormality or damage, so as to stop operation of the equipment as quickly as possible;

(14) Mixer overload reminder (not shown): regarding the mixer overload reminder, when the operating current exceeds the set abnormal current 15 or abnormal torsion 16, a message "feed mixer overload" is popped up in the middle of the image of the IO unit 1 and continues flashing, a beeper issues an alarm to remind the operating staff, and the mixer 3 at the same time is automatically deactivated. Upon elimination of the abnormality or to end the alarm and the image warning, the emergency stop switch may be pressed to again reset the switch.

As shown in FIG. 1, the mixer 3 may consist of a motor 31, a reduction gear 32, a frame group 33, the gear box group 34, a mixing element 35, the mixing can 36, and a lifting mechanism group 37. The motor 31, the reduction gear 32, the gear box group 34 and the lifting mechanism group 37 are all fixed on the frame group 33, the mixing element 35 is assembled in the gear box group 34, and the mixing can 36 is disposed on the lifting mechanism group 37.

Power transmission of the mixer 3 is powered by the motor 31 which is connected to the reduction gear 32 by a coupling and torsion meter 38. The reduction gear 32 is connected to the gear box group 34 by a coupling 39, and the mixing element 35 is assembled in a gear mechanism of the gear box group 34, thereby enabling the mixing element 35 to perform an expected movement by driving the motor 31.

Figure 5:
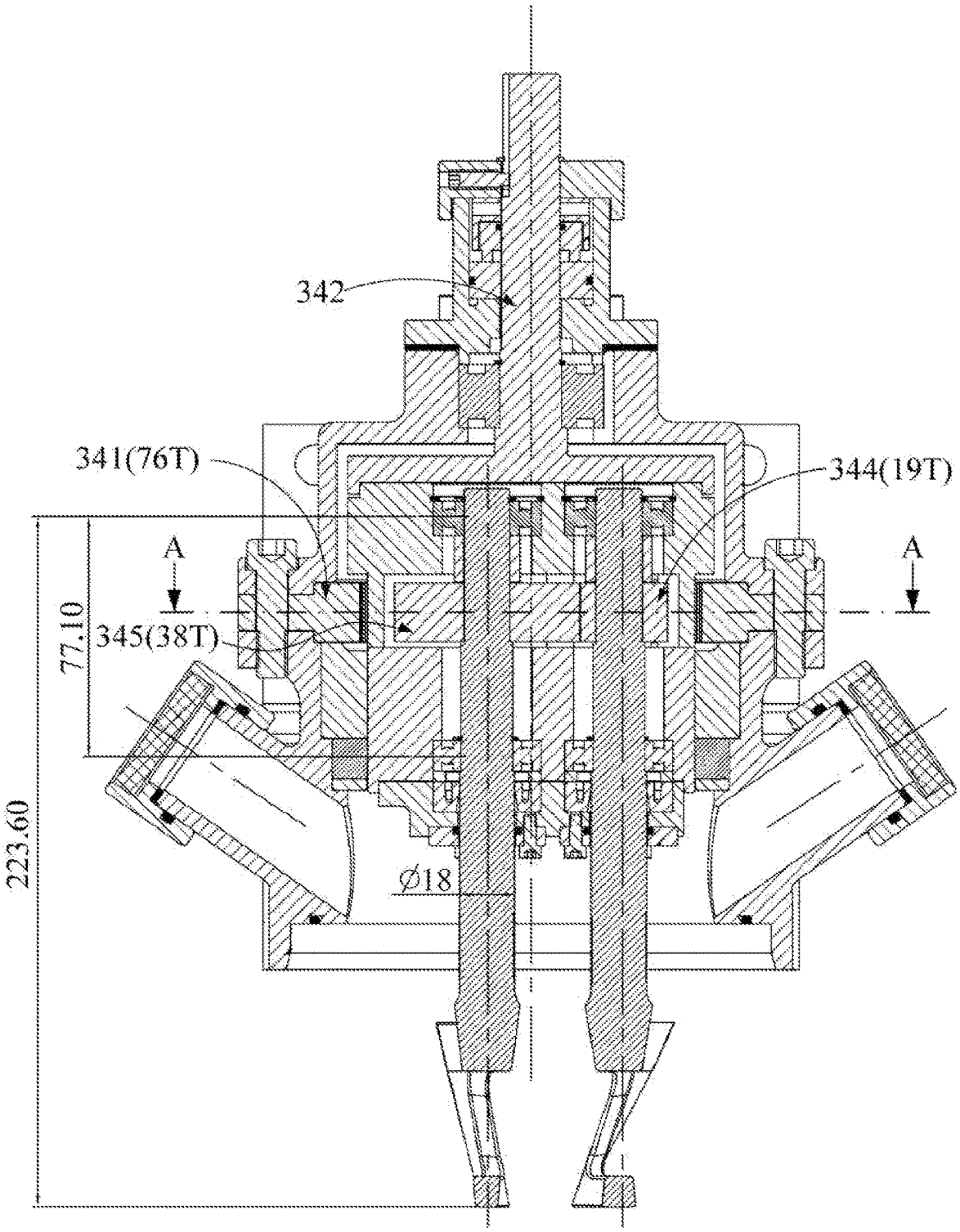
FIG. 5 is a section diagram of a gear box group of a mixer of a mini mixer system according to a preferred embodiment of the present invention.
Figure 6:
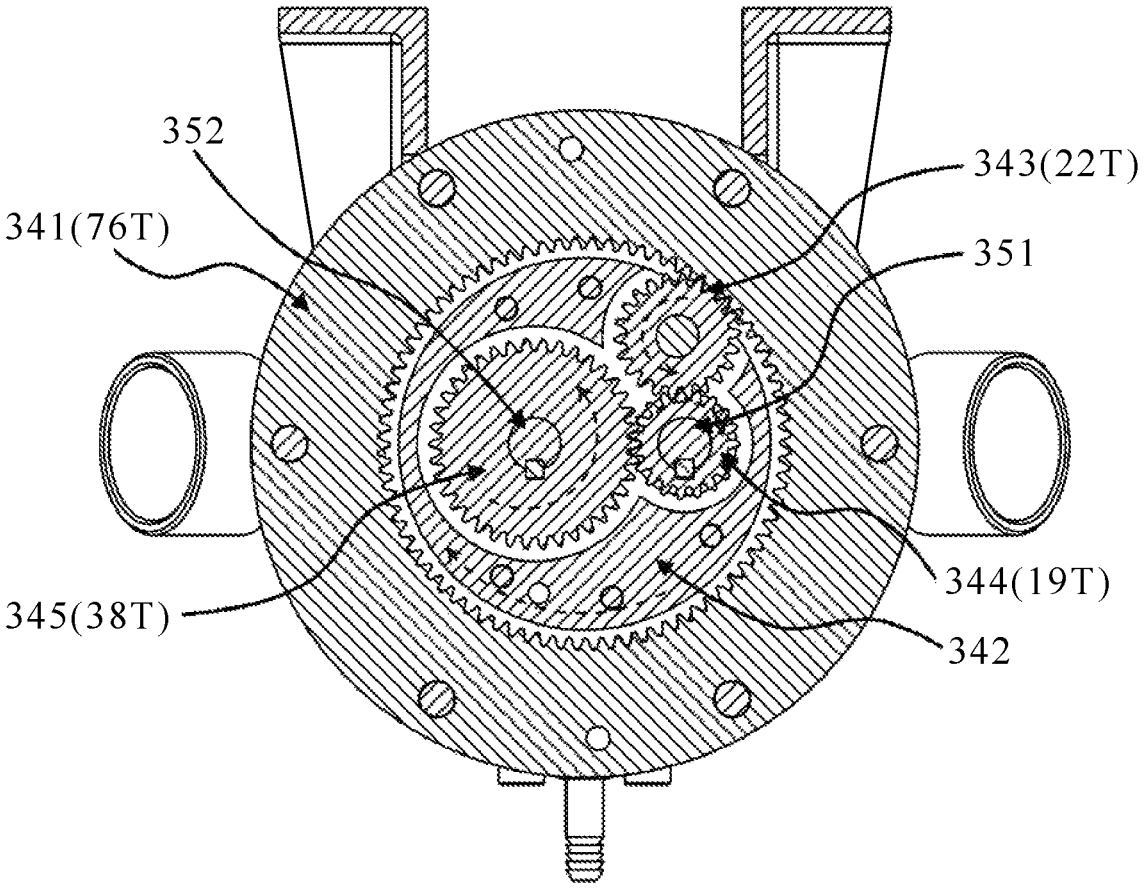
FIG. 6 is a section diagram of a gear box of a mixer of a mini mixer system according to a preferred embodiment of the present invention along A-A.

As shown by an assembly diagram of the gear box group 34 and the mixing element 35 in FIG. 5, the mixer is a vertical satellite dual mixing blade mixer, and the two mixing blades are double eccentric. A view with respect to AA is as shown in FIG. 6, and the numerals 341, 342, 343, 344 and 345 represent a member 341 (internal ring gear), a member 342 (main shaft), a member 343 (idler wheel), a member 344 (fast blade gear) and a member 345 (slow blade gear), wherein the value in the bracket represents the number of teeth, and for example, 341 (76T) represents the member 341 is a gear having a number of teeth of 76. The member 341 is an internal ring gear of the frame, the input member (actuating member) is the member 342, the member 341 and the member 342 are adjacent to each other as a revolution pair, the member 341 and the member 343 are adjacent as a gear pair (internal gear pair), the member 342 is simultaneously adjacent to the members 343, 344 and 345 as a revolution pair, the member 343 and the member 344 are adjacent as a gear pair (external gear pair), and the member 344 and the member 345 are adjacent as a gear pair (external gear pair).

Figure 10:
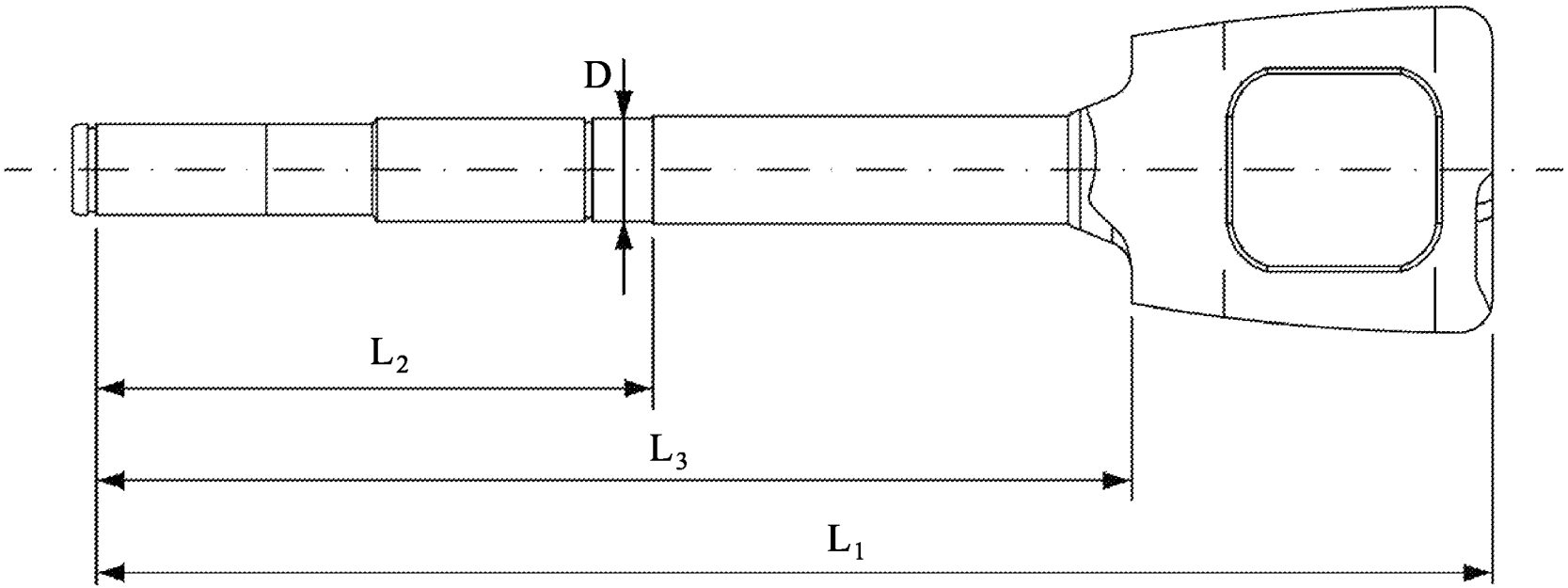
FIG. 10 is a diagram of dimension of mixing blade of a mini mixer system of the present invention.

FIG. 10 shows a diagram of dimensional of the mixing blade of the mini mixer system. With a ratio design concept of the present invention, in item no. 1 and item no. 2 in Table-1, it is indicated a force receiving arm of a mixing blade gets longer as the ratio increases, and thus the strength of the mixing blade gets poorer. Therefore, the structural strength of the mixing blades of the present mini mixer is better than that of the 2PX Vertical Mixer. In item 3, the section area increases as the bearing diameter increases, and therefore the shear resistance of the present feed mixer is 1.28 times of that of the 2PX Vertical Mixer. Stress analysis and comparison is performed by means of comparison, under the same conditions for material, received force and constraints, the amount of deformation of the blades of the present feed mixer is 0.36 (0.76 mm/2.11 mm) of the 2PX Vertical Mixer, hence effectively mitigating the deformation issue. Further, with measurement of vibration spectrum values, the vibration spectrum of the present system is better than that of the 2PX Vertical Mixer by APV Chemical Machinery Inc., and is 1/10 of that of said model.

TABLE 1

| Item No. | Item description | 2PX Vertical Mixer | Present mini mixer |
|---|---|---|---|
| 1 | Ratio of the length of a blade from the bottom to the top bearing divided by the waist bearing to the top bearing | 3.46 ($L_1/L_2$) | 2.51 ($L_1/L_2$) |
| 2 | Ratio of the length of a blade of the shoulder comparing to the waist bearing, both of those are from the top bearing | 2.58 ($L_3/L_2$) | 1.85 ($L_3/L_2$) |
| 3 | Shaft diameter of the blade at the bearing | 15 (D) | 17 (D) |

The mixing element 35 includes two mixing blades, one of which is a fast blade 351 and the other is a slow blade 352, which perform mutual blending by rotation and revolution. The mixing blade is structured such that the bearing length $L_1$ from the bottom of the blade to the head of the blade (the blade total length) is 200 mm to 240 mm, a shaft diameter D of the blade shaft at the bearing is 16 mm to 22 mm, the bearing length $L_2$ of the bearing from the waist of the blade to the head of the blade (the blade bearing support length) is 70 mm to 95 mm, and the bearing length $L_3$ from the shoulder of the blade to the head of the blade (a distance from the bottom of the mixing blade to the bearing) is 150 mm to 170 mm. According to such ratio design concept, one of the ratio, the length of the blade from the top bearing to the bottom divided by the length from the waist bearing to the top bearing, is 2.4 to 3.0, and the other ratio, the length of the blade from the top bearing to the shoulder divided by the length from the waist to the head of the blade, is 1.5 to 2.0, as characteristic dimensions of the design of the mixing blades. Thus, the structural design of the mixing blades is reinforced so as to improve the deformation issue of the mixing blades of the 2PX Vertical Mixer.

According to the connection relations above, when the member 342 is drive to rotate clockwise relative to the member 341, the member 343 rotates counterclockwise because the member 343 and the member 341 are adjacent as a gear pair (internal gear pair), the member 344 rotates clockwise because the member 343 and the member 344 are adjacent as a gear pair (external gear pair), the member 345 rotates counterclockwise because the member 344 and the member 345 are adjacent as a gear pair (external gear pair), the fast blade 351 rotates clockwise because the member 344 and the fast blade 351 are linked by a parallel key, and the slow blade 352 rotates counterclockwise because the member 345 and the slow blade 352 are linked by a parallel key.

Figure 7:
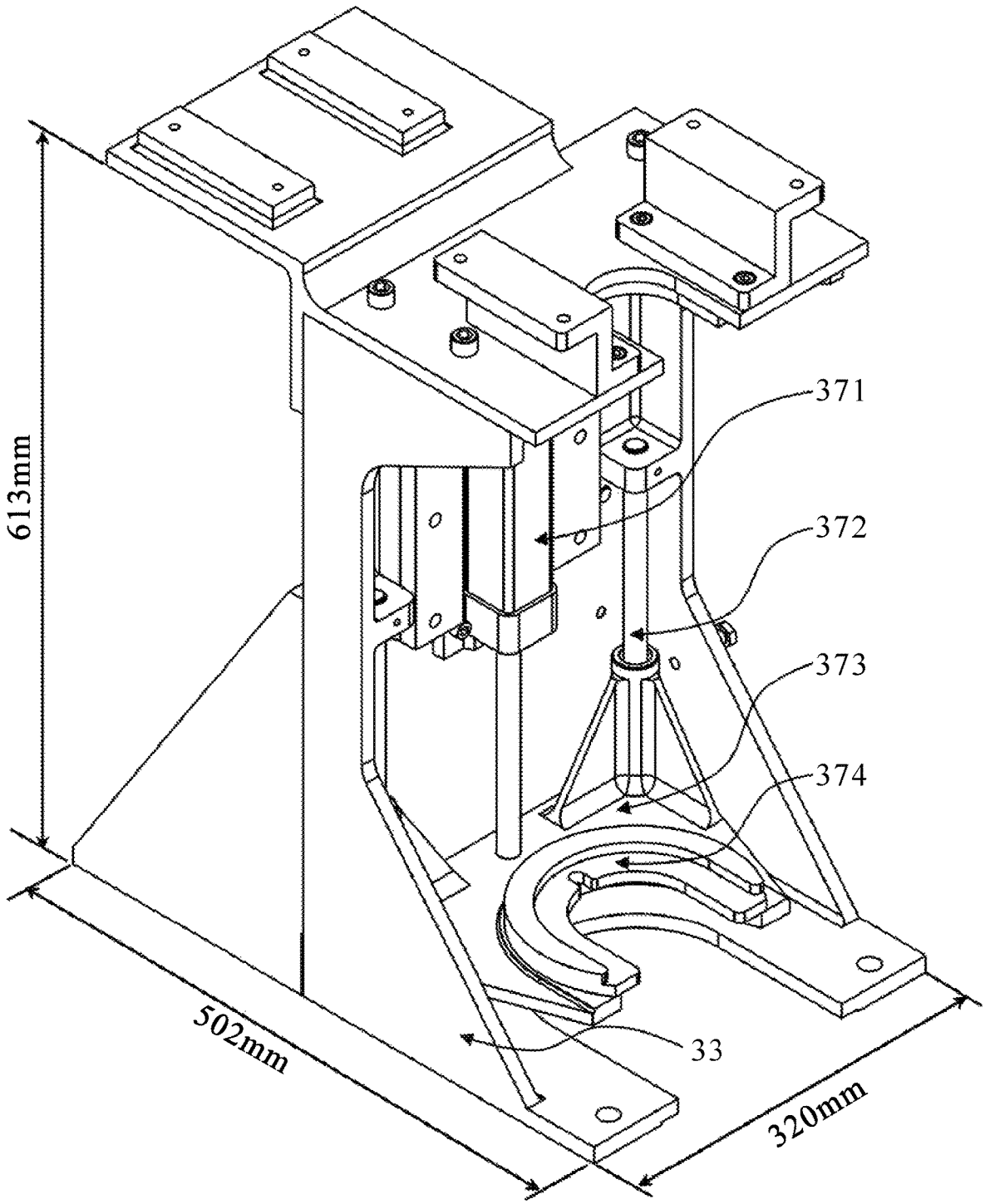
FIG. 7 is a schematic diagram of a frame group and a lifting mechanism group of a mixer of a mini mixer system according to a preferred embodiment of the present invention.

As shown in FIG. 7, the lifting mechanism group 37 includes a gas (oil) pressure cylinder 371, a guide column 372, a lifting socket 373, and a mixing can socket 374. The gas (oil) cylinder 371 is fixed on the frame group 33, one end of a piston rod on the gas (oil) cylinder 371 is fixedly connected to the lifting socket 373 by a screw bolt, the guide column 372 is fixed on the frame group 33, the lifting socket 373 and the guide column 372 are slidably connected, and a switch valve 331 is operated to extend or withdraw the gas (oil) cylinder 371.

Figure 8:
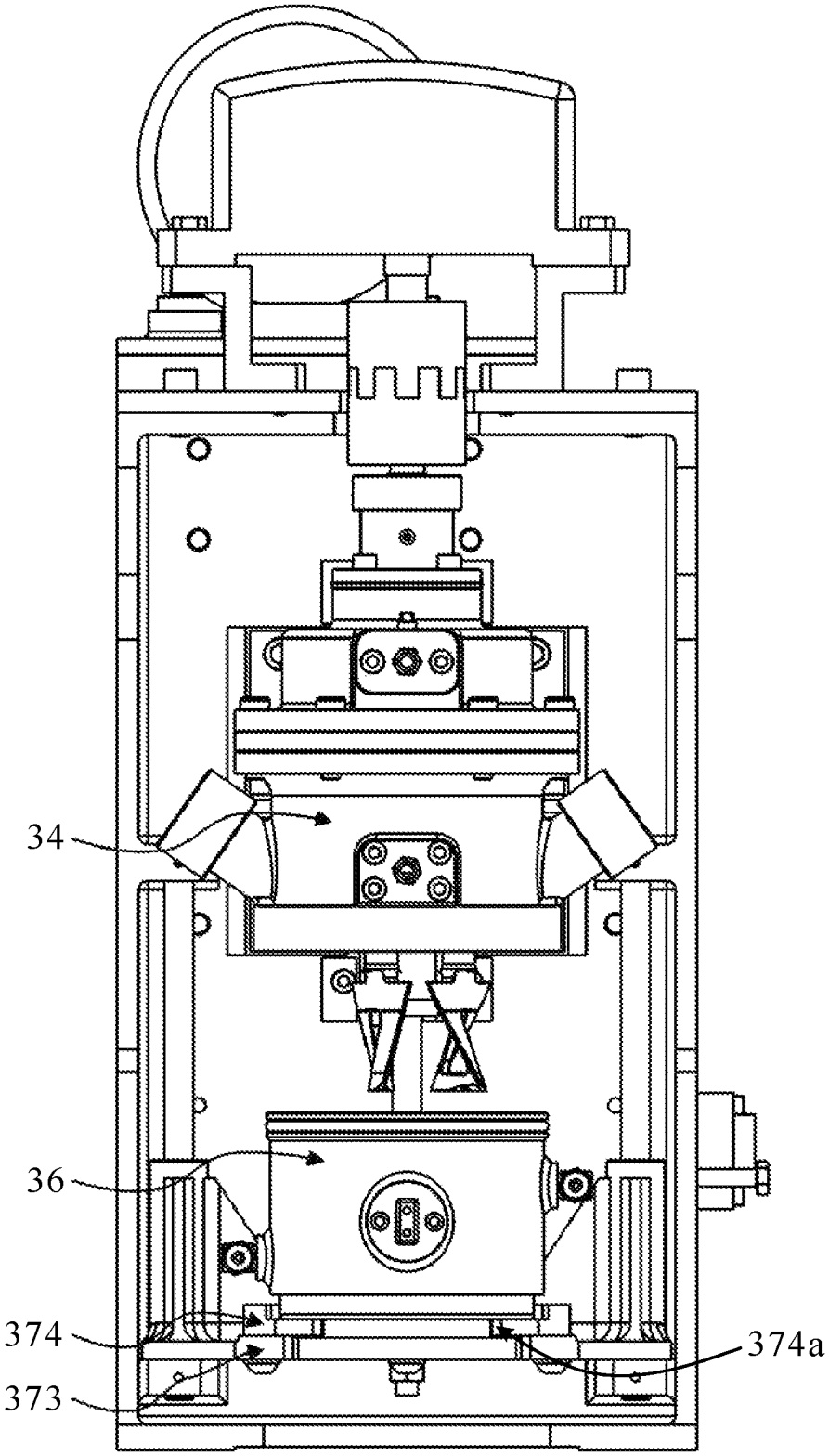
FIG. 8 is a front view of a mixer of a mini mixer system according to a preferred embodiment of the present invention.

As shown in FIG. 8, the mixing can socket 374 is installed on the lifting socket 373, the mixing can 36 is on the mixing can socket 374, and the mixing can 36 may ascend or descend as expected according to the operation details above. The mixing can socket 374 includes an adjustment flange 374*a* having a center calibration function, and provides a levelled adjustment margin of 1 mm to 2 mm. When the mixing can 36 ascends to be closely adhered to the gear box group 34, if eccentricity occurs such that ascending to a located position cannot be smoothly performed, center calibration may be performed by adjusting the mixing can feed socket 374, so as to prevent locating issues of the mixing can and the gear box group caused by accumulated assembly errors or processing errors.

Figure 9:
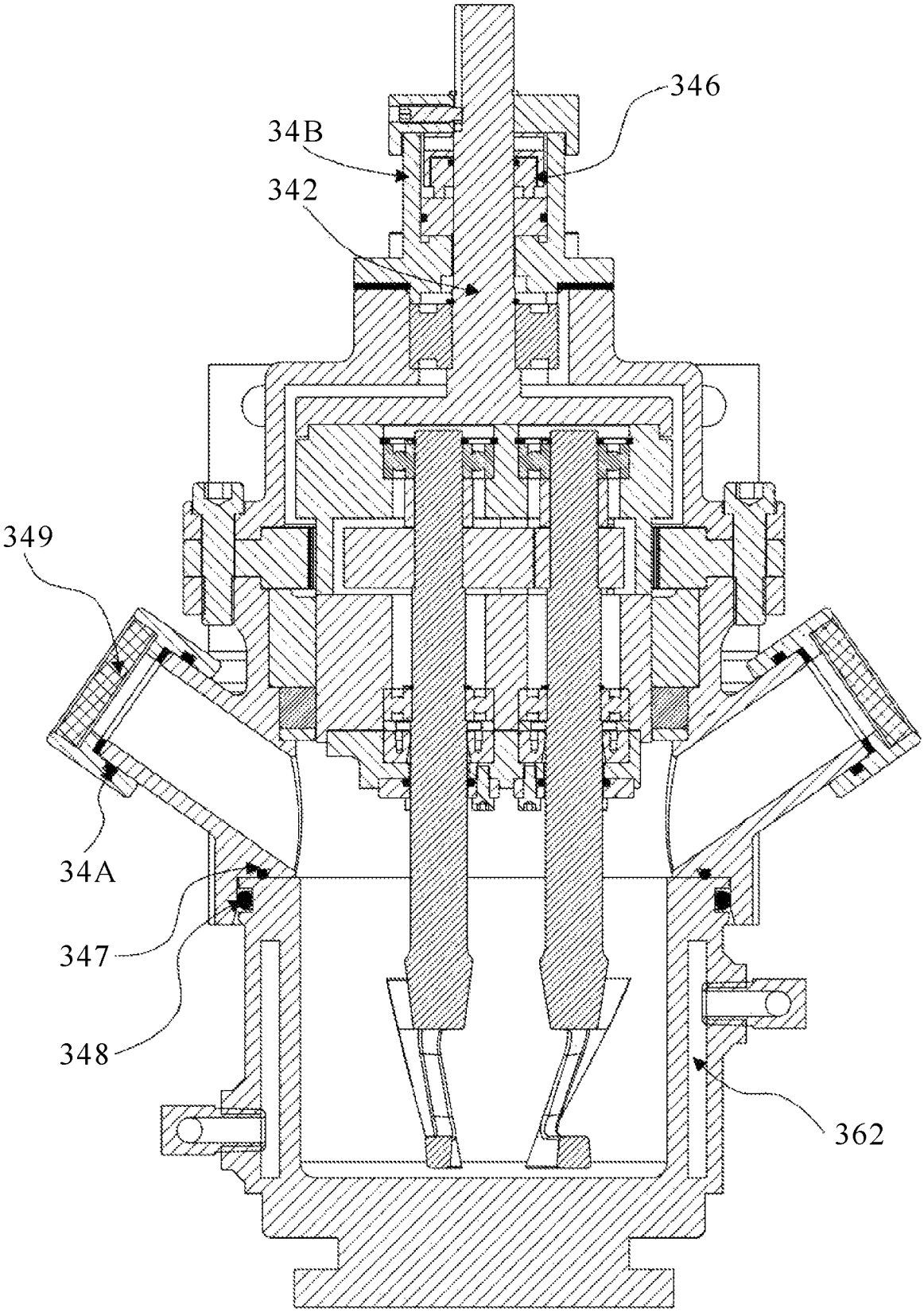
FIG. 9 is a section diagram of a mixer of a mini mixer system according to a preferred embodiment of the present invention.

FIG. 9 shows a schematic diagram of an assembly of the gear box group 34 and the mixing can 36. To form a negative pressure on the inside of the mixing can 36 by using a vacuum pump, a mechanical shaft seal 346 is added between the main shaft 342 and the gear box body 34B, and an O ring 34A is added between the gear box body 34B and a view window 349. The view window 349 has a sealing vacuum degree of 10 torr or less and has a burst pressure relief function. By adding the O ring 347 and the O ring 348 at contact interfaces of the gear box body 34B and the mixing can 36, the mixing can 36 forms a sealed chamber isolated from the outside. The gear box group 34 and the mixing can 36 are then vacuumed from the vacuum pipeline 41 of the vacuum pump 4, and a negative state can be formed inside the chamber, so as to create a vacuum environment of feed mixing, reduce the content of gas in the mixture, and enhance mixing efficiency.

In conclusion, by the design concept of an adjustment flange of the present invention, a levelled adjustment margin of 1 mm to 2 mm is provided, so as to prevent locating issues of the mixing can and the gear box caused by accumulated assembly errors or processing errors. In the present invention, a nested view window is further designed, and the sealing vacuum degree of the view window may adapt to vacuum requirements so as to be 10 torr or less, hence improving the issue of vacuum leakage of the 2PX Vertical Mixer. Further, due to the possibility of explosion during the stirring and mixing process of an energetic material that is a sensitive mixture, a pressure relief hole is required, and the nested view window also provides such burst pressure relief function. In the present invention, a mixer system having functions of controlling the mixing time and mixing rotating speed is designed. The mixer system has three-stage or multi-stage parameter settings, and may be set to perform a three-stage or multi-stage continuous stepped operation for a target time at a predetermined rotating speed, hence optimizing mixing production time. Further, real-time current, rotating speed and torsion records, as well as an overload determination mechanism for monitoring whether or not the motor current or motor torsion is abnormal, are included, so as to further enhance safety and operability of equipment. In the present invention, a rotary torsion meter connected in series in the power system is designed, and the torsion value is returned to the IO unit for monitoring, so that the change in torsion may be tracked during the mixing process, and the motor rotating speed is appropriately reduced according to the torsion value to mitigate danger during the mixing process. That is, the rotating speed is timely increased when the torsion value drops to increase the mixing cycle, thus further reducing the mixing time and prolonging the durability of equipment. Further, the amount and viscosity of feed corresponding to the torsion value may be used as comparison data for reference of preliminary viscosity testing, thus effectively decreasing the number of operations in sampling and detecting viscosity. In the present invention, a mixer system featuring functions of quick release, transportation and installation is designed, wherein the IO unit, the powering and control unit and the mixer are connected by quick connectors in between, thereby improving the issues of removal and installation inconveniences caused by independent system wires of the 2PX Vertical Mixer, quickly separating or assembling three main systems and increasing the reliability of systems. In the present invention, using a ratio design concept, the strength of mixing blades is increased to mitigate the issue of deformation, and the vibration spectrum value provided is relatively small.

The foregoing embodiments are examples for illustrating the features and effects of the present invention, and are not to be construed as limitations to the scope of substantive technical contents of the present invention. Without departing from the spirit of scope of the present invention, modifications and variations may be made by a technician to the foregoing embodiments. Therefore, the claimed scope of the present invention is to be accorded with the appended claims.

What is claimed is:

1. A mini mixer system, comprising:

a mixer, for executing a continuous mixing operation for an extended period of time, wherein the mixer comprises a motor, a coupling and torsion meter, a reduction gear, a plurality of couplings, a frame group, a gear box group, at least one mixing element, a mixing can, and a lifting mechanism group, wherein the motor, the coupling and torsion meter and the reduction gear are connected by the couplings, the reduction gear is connected to the gear box group by the coupling, the motor, the reduction gear, the gear box group and the lifting mechanism group are all fixed on the frame group, the mixing element is assembled in a gear mechanism of the gear box group, and the mixing can is placed on the lifting mechanism group;

an input/output (TO) unit, disposed in a control room and serving as a remote control interface, electrically connected to the mixer, the IO unit having control functions of mixer activation and deactivation function, mixer three-stage or multi-stage operation time and rotating speed setting function, total operation time display function, execution record window display function, setting detection of abnormal current and detection delay time function, real-time detected motor current display function, real-time motor rotating speed display function, real-time detected motor torsion display function, mixing can temperature display function, mixer overload reminder function, an emergency stop switch, and abnormality detection description, wherein the mixer three-stage or multi-stage operation time and rotating speed setting function sets the motor of the mixer to perform a continuous stepped operation for a target time at a predetermined rotating speed; and a powering and control unit, disposed near the mixer, electrically connected to the mixer and the IO unit, serving as a main power supply box of the mixer, and as an intermediary station of control signals and detection signals between the IO unit and the mixer;

wherein the gear box group comprises a gear box body and a view window, an O ring is added between the gear box body and the view window, and the view window has a sealing vacuum degree of 10 torr and less and has a burst pressure relief function.

2. The mini mixer system according to claim 1, wherein the IO unit, the powering and control unit and the mixer are connected by quick connectors in between so as to quickly separate or assemble the IO unit, the powering and control unit and the mixer for functions of quick release, transportation and installation.

3. The mini mixer system according to claim 1, wherein the mixing element comprises two mixing blades, the two mixing blades are a fast blade and a slow blade that perform a mutual mixing operation by rotation and revolution, a bearing length from a bottom of the blade to a head of the blade is 200 mm to 240 mm, a shaft diameter of a blade shaft at a bearing is 16 mm to 22 mm, a bearing length from a waist of the blade to the head of the blade is 70 mm to 95 mm, a bearing length from a shoulder of the blade to the head of the blade is 150 mm to 170 mm, a length ratio of the top bearing to bottom of the blade comparing to the waist bearing to the top bearing of the blade is 2.4 to 3.0, and a length ratio of the top bearing to the shoulder of the blade comparing to the waist bearing to the top bearing of the blade is 1.5 to 2.0.

4. The mini mixer system according to claim 1, further comprising:

a hot water circulation system, comprising an electric water heater, a water pump and a temperature sensor, being connected to the mixing can by a heat resistant water pipe and a quick connector;

wherein, a wall of the mixing can comprises a sandwich design which is in conjunction with the hot water circulation system to heat the mixing can, the mixing can is simultaneously installed with the temperature sensor, monitoring is performed by the IO unit, the sandwich design is for creating a high temperature mixing environment so as to increase ease of mixing of a mixture and reduce mixing viscosity of the mixture.

5. The mini mixer system according to claim 1, wherein the IO unit comprises a key-type power-off switch; when operating staff is to head from the control room to a location of the mixer, a power supply of the IO unit is turned off by the key-type power-off switch to prevent an unintentional operation of the IO unit and prevent false touch.

6. The mini mixer system according to claim 1, further comprising:

a vacuum pump, connected to the mixer by a vacuum pipe, simultaneously vacuuming the mixing can and the gear box group to create a vacuum environment of feed mixing, reduce a content of gas in a mixture and enhance mixing efficiency.

7. The mini mixer system according to claim 1, wherein the frame group comprises an adjustment flange that provides a levelled adjustment margin of 1 mm to 2 mm, so as to prevent locating issues of the mixing can and the gear box group caused by accumulated assembly errors or processing errors.

8. A mini mixer system, comprising:

a mixer, for executing a continuous mixing operation for an extended period of time, wherein the mixer comprises a motor, a coupling and torsion meter, a reduction gear, a plurality of couplings, a frame group, a gear box group, at least one mixing element, a mixing can, and a lifting mechanism group, wherein the motor, the coupling and torsion meter and the reduction gear are connected by the couplings, the reduction gear is connected to the gear box group by the coupling, the motor, the reduction gear, the gear box group and the lifting mechanism group are all fixed on the frame group, the mixing element is assembled in a gear mechanism of the gear box group, and the mixing can is placed on the lifting mechanism group;

an input/output (TO) unit, disposed in a control room and serving as a remote control interface, electrically connected to the mixer, the IO unit having control functions of mixer activation and deactivation function, mixer three-stage or multi-stage operation time and rotating speed setting function, total operation time display function, execution record window display function, setting detection of abnormal current and detection delay time function, real-time detected motor current display function, real-time motor rotating speed display function, real-time detected motor torsion display function, mixing can temperature display function, mixer overload reminder function, an emergency stop switch, and abnormality detection description, wherein the mixer three-stage or multi-stage operation time and rotating speed setting function sets the motor of the mixer to perform a continuous stepped operation for a target time at a predetermined rotating speed; and a powering and control unit, disposed near the mixer, electrically connected to the mixer and the IO unit, serving as a main power supply box of the mixer, and as an intermediary station of control signals and detection signals between the IO unit and the mixer;

wherein the mixing element comprises two mixing blades, the two mixing blades are a fast blade and a slow blade that perform a mutual mixing operation by rotation and revolution, a bearing length from a bottom of the blade to a head of the blade is 200 mm to 240 mm, a shaft diameter of a blade shaft at a bearing is 16 mm to 22 mm, a bearing length from a waist of the blade to the head of the blade is 70 mm to 95 mm, a bearing length from a shoulder of the blade to the head of the blade is 150 mm to 170 mm, a length ratio of the top bearing to bottom of the blade comparing to the waist bearing to the top bearing of the blade is 2.4 to 3.0, and a length ratio of the top bearing to the shoulder of the blade comparing to the waist bearing to the top bearing of the blade is 1.5 to 2.0.

9. The mini mixer system according to claim 8, wherein the TO unit, the powering and control unit and the mixer are connected by quick connectors in between so as to quickly separate or assemble the TO unit, the powering and control unit and the mixer for functions of quick release, transportation and installation.

10. The mini mixer system according to claim 8, further comprising:

a hot water circulation system, comprising an electric water heater, a water pump and a temperature sensor, being connected to the mixing can by a heat resistant water pipe and a quick connector;

wherein, a wall of the mixing can comprises a sandwich design which is in conjunction with the hot water circulation system to heat the mixing can, the mixing can is simultaneously installed with the temperature sensor, monitoring is performed by the TO unit, the sandwich design is for creating a high temperature mixing environment so as to increase ease of mixing of a mixture and reduce mixing viscosity of the mixture.

11. The mini mixer system according to claim 8, wherein the TO unit comprises a key-type power-off switch; when operating staff is to head from the control room to a location of the mixer, a power supply of the TO unit is turned off by the key-type power-off switch to prevent an unintentional operation of the IO unit and prevent false touch.

12. The mini mixer system according to claim 8, further comprising:

a vacuum pump, connected to the mixer by a vacuum pipe, simultaneously vacuuming the mixing can and the gear box group to create a vacuum environment of feed mixing, reduce a content of gas in a mixture and enhance mixing efficiency.

13. The mini mixer system according to claim 8, wherein the frame group comprises an adjustment flange that provides a levelled adjustment margin of 1 mm to 2 mm, so as to prevent locating issues of the mixing can and the gear box group caused by accumulated assembly errors or processing errors.

* * * * *